US010834983B2

(12) United States Patent
Cherry et al.

(10) Patent No.: US 10,834,983 B2
(45) Date of Patent: Nov. 17, 2020

(54) GARMENT POCKET

(71) Applicant: NIKE, Inc., Beaverton, OR (US)

(72) Inventors: Cadman J. Cherry, Beaverton, OR (US); Luke Hammer, Portland, OR (US); Heather E. Radich, Lake Oswego, OR (US)

(73) Assignee: NIKE, INC., Beaverton, OR (US)

( * ) Notice: Subject to any disclaimer, the term of this patent is extended or adjusted under 35 U.S.C. 154(b) by 221 days.

(21) Appl. No.: 15/799,578

(22) Filed: Oct. 31, 2017

(65) Prior Publication Data

US 2018/0116315 A1 May 3, 2018

Related U.S. Application Data

(60) Provisional application No. 62/416,219, filed on Nov. 2, 2016.

(51) Int. Cl.
*A41D 27/20* (2006.01)
*A41D 13/00* (2006.01)

(52) U.S. Cl.
CPC ..... *A41D 27/20* (2013.01); *A41D 13/0012* (2013.01); *A41D 2600/10* (2013.01)

(58) Field of Classification Search
CPC .... A41D 27/20; A41D 27/204; A41D 27/205; A41D 27/207; A41D 13/0012; A41D 2600/10
USPC ..... 2/247, 250
See application file for complete search history.

(56) References Cited

U.S. PATENT DOCUMENTS 1,982,100 A * 11/1934 Heile ..... A41D 27/20 2/253
2,150,251 A * 3/1939 Shanhouse ..... A41D 13/0012 2/94
2,405,964 A 8/1946 Lauria
2,489,868 A * 11/1949 Dowling ..... A41D 27/20 2/253
2,663,876 A * 12/1953 Miller ..... A41D 1/06 2/227
3,334,357 A 8/1967 Stults
(Continued)

FOREIGN PATENT DOCUMENTS

CN 201805944 U 4/2011
CN 204409623 U 6/2015
(Continued)

OTHER PUBLICATIONS

International Preliminary Report on Patentability dated May 16, 2019 in International Patent Application No. PCT/US2017/059556, 8 pages.
(Continued)

*Primary Examiner* — Alissa L Hoey
(74) *Attorney, Agent, or Firm* — Shook, Hardy & Bacon, LLP

(57) ABSTRACT

Aspects herein provide for a pocket structure for a garment that is configured to effectively stow and secure objects such as balls. The pocket structure comprises a gusset insert located on an outer-facing panel of the pocket structure and a pleat structure located on an inner-facing panel of the pocket structure. The gusset insert and the pleat structure work in combination to increase the interior volume of the pocket structure to effectively accommodate the stored object.

14 Claims, 9 Drawing Sheets

(56) References Cited

U.S. PATENT DOCUMENTS

| | | | | |
|---|---|---|---|---|
| 3,744,059 | A | 7/1973 | Hayes | |
| 3,968,522 | A | 7/1976 | Riess | |
| 4,079,871 | A * | 3/1978 | Sica | A45C 11/00 224/677 |
| 4,301,549 | A | 11/1981 | Ingram | |
| 4,513,455 | A | 4/1985 | Gerhardt | |
| 4,718,124 | A * | 1/1988 | Sawicki | A41D 13/129 2/114 |
| 5,509,147 | A * | 4/1996 | Busquets | A41D 27/202 112/441 |
| 5,636,386 | A | 6/1997 | Salamone | |
| 5,720,050 | A | 2/1998 | Gioli | |
| 5,784,719 | A * | 7/1998 | Robinson | A41D 3/00 2/93 |
| 6,110,156 | A | 8/2000 | Mendonca | |
| 6,131,198 | A * | 10/2000 | Westrick | F41C 33/0209 2/102 |
| 6,328,146 | B1 * | 12/2001 | Siwak | A45C 3/00 150/106 |
| D465,659 | S | 11/2002 | Vazquez | |
| D591,930 | S | 5/2009 | Lorenzi | |
| 7,681,255 | B2 * | 3/2010 | Morales | A41D 1/06 2/247 |
| 7,908,675 | B2 * | 3/2011 | Robinson | A41D 27/20 2/247 |
| 8,505,118 | B2 | 8/2013 | Bang | |
| 9,557,139 | B1 * | 1/2017 | Miner | F41C 33/0218 |
| 9,775,428 | B2 * | 10/2017 | Johnson | A45F 5/00 |
| 2003/0172442 | A1 * | 9/2003 | Widmer | A41D 27/20 2/247 |
| 2003/0205595 | A1 * | 11/2003 | Young | A45F 5/02 224/230 |
| 2004/0045325 | A1 | 3/2004 | Rabinowicz et al. | |
| 2004/0052434 | A1 * | 3/2004 | Bell | B65D 33/007 383/35 |
| 2006/0070163 | A1 | 4/2006 | Beck et al. | |
| 2009/0126079 | A1 * | 5/2009 | Kato | A41F 9/02 2/237 |
| 2009/0126080 | A1 * | 5/2009 | Kato | A41D 1/06 2/237 |
| 2009/0229037 | A1 * | 9/2009 | Bugni | A41D 27/20 2/250 |
| 2009/0282600 | A1 | 11/2009 | Robinson | |
| 2011/0072556 | A1 * | 3/2011 | Bang | A41D 27/08 2/227 |
| 2012/0030864 | A1 * | 2/2012 | Marois | A41D 13/0012 2/251 |
| 2012/0304357 | A1 * | 12/2012 | Highfield | A41D 1/002 2/69 |
| 2013/0067630 | A1 * | 3/2013 | French | A41D 27/20 2/69 |
| 2015/0108182 | A1 * | 4/2015 | Bruce | A45C 3/001 224/148.1 |
| 2015/0128331 | A1 | 5/2015 | Grosse | |
| 2016/0007662 | A1 | 1/2016 | Powell | |
| 2016/0015103 | A1 | 1/2016 | Gray | |
| 2016/0120245 | A1 * | 5/2016 | Novela | A41D 27/204 2/253 |

FOREIGN PATENT DOCUMENTS

| | | | |
|---|---|---|---|
| CN | 105077738 | A | 11/2015 |
| CN | 205512427 | U | 8/2016 |
| MX | 9703883 | A | 11/1998 |

OTHER PUBLICATIONS

"Leggings with Hidden Ball Pockets Royal Blue," BPassionIt®, bpassionit.com, accessed: Jul. 2016. http://bpassionit.com/product/winterleggingswithhiddenballpocketsroyalblue/, 1 page.

"InBetween Skirt & Shortie w/ 2 Pockets 90M," Do It Tennis™, doittennis.com, accessed: Jul. 2016. http://www.doittennis.com/apparel/inbetween/apparelinbelween-skirtshortiew2pockets.php, 1 page.

International Search Report and Written Opinion dated Feb. 1, 2018 in International Patent Application No. PCT/US2017/059556, 14 pages.

* cited by examiner

GARMENT POCKET

CROSS-REFERENCE TO RELATED APPLICATIONS

This application having attorney docket number NIKE.281561/160283US02 and entitled "GARMENT POCKET" claims the benefit of priority of U.S. Provisional Application No. 62/416,219, entitled "GARMENT POCKET," and filed on Nov. 2, 2016, which is incorporated by reference in its entirety.

TECHNICAL FIELD

Aspects herein related to a garment pocket having a construction suitable to seat and secure a spherical object, such as a ball, within the pocket.

BACKGROUND

Garment pockets are traditionally used to secure and/or stow objects. However, it has generally been difficult to stow bulky or spherical-shaped objects without distorting the appearance of the garment and/or potentially causing wearer discomfort due to the object pressing against the wearer's body.

BRIEF DESCRIPTION OF THE DRAWINGS

Examples of the present invention are described in detail below with reference to the attached drawing figures, wherein.

DETAILED DESCRIPTION

Figure 1A:
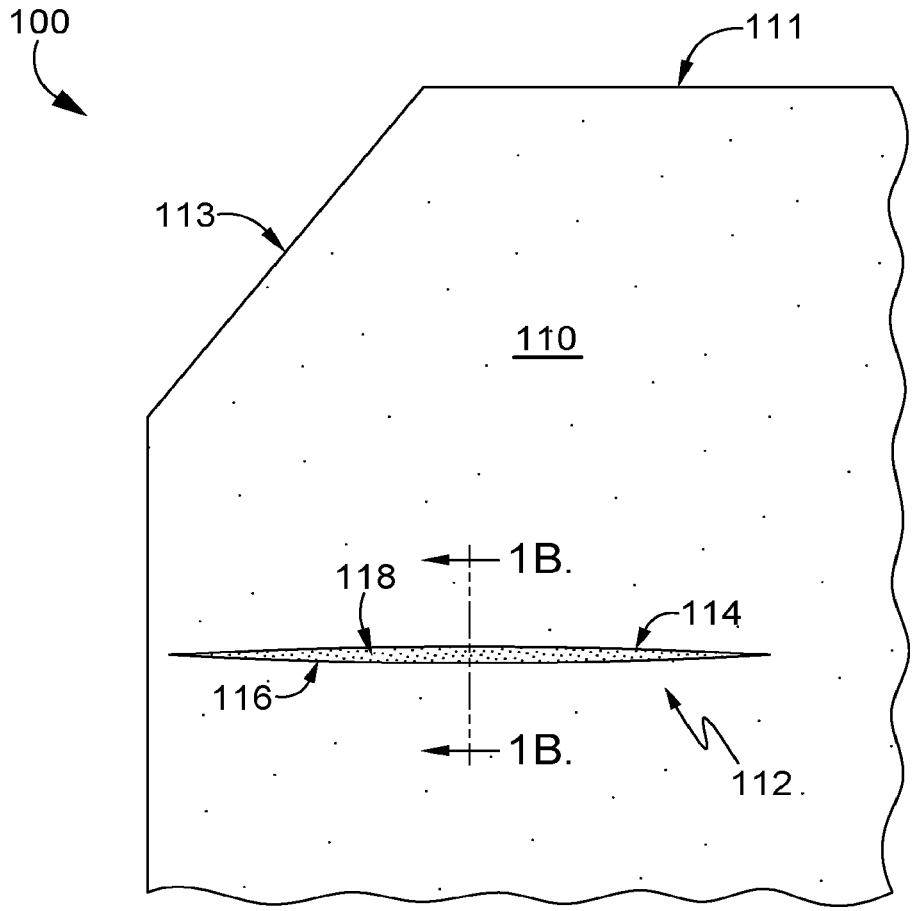
FIG. 1A illustrates a view of a first surface of a portion of a first panel of material used to form an exemplary pocket structure where the first panel of material includes a gusset insert shown in an unexpanded state in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein relate to a pocket structure for a garment where the pocket structure is configured to stow and secure a generally spherical-shaped object such as a ball. The object is stowed in such a way so as to improve wearer comfort, help maintain the aesthetic appearance of the garment, and help prevent the inadvertent escape of the object from the pocket structure. More particularly, the pocket structure comprises a gusset insert located on a first panel of material that forms the outer-facing portion or surface of the pocket structure when the garment is worn. The pocket structure further comprises a pleat structure having one or more folds formed from a second panel of material that forms the inner-facing portion or surface of the pocket structure. In exemplary aspects, the pleat structure is located at the bottom margin of the pocket structure. Continuing, the long axes of the gusset insert and the pleat structure are generally in parallel alignment with each other, and the pleat structure is positioned a predetermined distance below or inferior to the gusset insert when the garment is worn.

Continuing, when not used to stow an object, the gusset insert and the pleat structure of the pocket structure remain in a flat and/or folded state causing the pocket structure as a whole to present a generally flat or planar aspect. However, when an object such as, for example, a ball is stowed within the pocket structure, both the gusset insert and the pleat structure expand or unfold to accommodate the ball. When stowed within the pocket structure, the bottom of the ball is configured to be positioned adjacent to the pleat structure due to the pleat structure forming, at least in part, the bottom margin of the pocket structure. The positioning of the bottom of the ball adjacent to the pleat structure causes the pleat structure to expand or unfold in order to accommodate the ball. As mentioned, the gusset insert is positioned a predetermined distance superior to the pleat structure. In exemplary aspects, the predetermined distance is selected based on the diameter of the ball likely to be stowed within the pocket structure. For example, the predetermined distance may be equal to half of the ball's diameter (i.e., the ball's radius). Thus, when the bottom of the ball is positioned adjacent to the pleat structure, the portion of the ball corresponding to its greatest circumference (i.e., the ball's equator) is positioned adjacent to the gusset insert and the gusset insert expands or unfolds to accommodate the ball's circumference. As seen, the positional relationship between the gusset insert and the pleat structure helps to secure and seat the ball when the ball is stowed in the pocket structure, thus preventing the ball from inadvertently escaping the pocket structure. This structure may be opposed to more traditional pocket structures formed without a pleat structure and/or gusset. These traditional types of pockets may not have enough interior volume to accommodate and seat the ball.

Moreover, by positioning the gusset insert on the outer-facing panel of the pocket structure, the pocket structure generally expands outward or away from the wearer's body when the ball is stowed within the pocket structure. This may stand in contrast to typical pocket constructions that lack a gusset insert, where such constructions generally expand both towards a wearer's body and away from the wearer's body when an object such as a ball is stowed within the pocket, thus possibly increasing wearer discomfort and/or inhibiting wearer movement when the object is stowed.

Further still, the use of both the gusset insert and the pleat structure allows for sufficient expansion of the pocket structure so as to accommodate the stowed object. A result of this expansion is that unwanted tension forces on other areas of the garment are reduced or minimized. For instance, when stowing an object such as ball in a typical pocket structure incorporated into, for instance, a pair of shorts, the bottom margin of the leg portions might be pulled upward due to the tension forces caused by stowing the ball within a pocket that does not have sufficient internal volume to accommodate the ball. This pulling of the bottom margin not only presents an unsightly aesthetic appearance but may also contribute to wearer discomfort.

Accordingly, aspects herein are directed to a pocket structure comprising a first panel of material having a first surface and a second surface opposite the first surface, where the first panel of material comprises a gusset insert expandable from a first state to a second state. The pocket structure further comprises a second panel of material affixed to the first panel at one or more perimeter edges of the second panel of material, where the second panel of material comprises a third surface and a fourth surface opposite the third surface. The second panel of material is affixed to the first panel of material so that the second panel's fourth surface is positioned adjacent to the first panel's second surface. Further, at least a first perimeter edge of the second panel of material has a pleat structure expandable from a first state to a second state.

Aspects herein further provide for a garment comprising a torso portion defining at least a waist opening and first and second leg portions extending from the torso portion, where the first and second leg portions define first and second leg openings respectively. The garment further comprises a pocket structure having a first panel of material comprising a first surface and a second surface opposite the first surface. The first panel of material comprises a gusset insert that is located a first distance from the waist opening of the garment, where the gusset insert expandable from a first state to a second state. The pocket structure further comprises a second panel of material affixed to the first panel of material at one or more perimeter edges of the second panel of material, where the second panel of material comprises a third surface and a fourth surface opposite the third surface. The second panel of material is affixed to the first panel of material so that the second panel's fourth surface is positioned adjacent to the first panel's second surface. At least a first perimeter edge of the second panel of material has a pleat structure expandable from a first state to a second state, where the pleat structure is located a second distance from the waist opening of the garment.

Aspects herein are further directed to a garment comprising a torso portion defining at least a neck opening, a waist opening, a first sleeve opening, and a second sleeve opening. The garment further comprises a pocket structure having a first panel of material comprising a first surface and a second surface opposite the first surface, where the first panel of material comprises a gusset insert that is located a first distance from the neck opening of the garment. The gusset insert is expandable from a first state to a second state. The pocket structure further comprises a second panel of material affixed to the first panel at one or more perimeter edges of the second panel of material, where the second panel of material comprises a third surface and a fourth surface opposite the third surface. The second panel of material is affixed to the first panel of material so that the second panel's fourth surface is positioned adjacent to the first panel's second surface. At least a first perimeter edge of the second panel of material has a pleat structure expandable from a first state to a second state, where the pleat structure is located a second distance from the neck opening of the garment.

As used throughout this disclosure, positional terms used when describing, for instance, a garment or portions of a garment, such as "anterior," "posterior," "inferior," "superior," "lateral," "medial," "superior," and the like are to be given their common meaning with respect to the garment being worn by a hypothetical wearer standing in anatomical position. Unless indicated otherwise, terms such as "affixed," "coupled," "secured," and the like may mean releasably affixing two or more elements together using for instance, structural differences between the elements, releasable adhesives, snaps, buttons, hook-and-loop fasteners, and the like. These terms may also mean permanently affixing two or more elements together using, for example, stitching, bonding, adhesives, welding, and the like.

As used throughout this disclosure, the term "bottom" as in a "bottom margin of a pocket structure" is not meant to imply a particular orientation of the bottom margin such as a horizontal orientation. But, instead, the term "bottom" is meant to convey the portion of the pocket structure at which objects stowed within the pocket structure generally settle due to gravity. Thus, the bottom margin of the pocket structure may assume a horizontal orientation, a near-horizontal orientation, or a diagonal orientation when a garment incorporating the pocket structure is worn. In some aspects, the bottom margin will be opposite the pocket opening. Further, as used throughout this disclosure, the term "upper" as in an "upper margin of a pocket structure," may be defined as the portion of the pocket structure opposite the bottom margin of the pocket structure. In exemplary aspect, the upper margin of the pocket structure may be that portion of the pocket structure that forms, at least in part, the opening to the pocket structure.

Figure 1B:
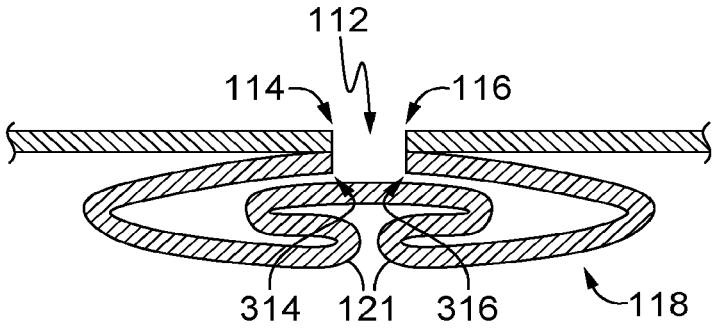
FIG. 1B illustrates a cross-sectional view taken along cut line 1B-1B in accordance with aspects herein.
Figure 2A:
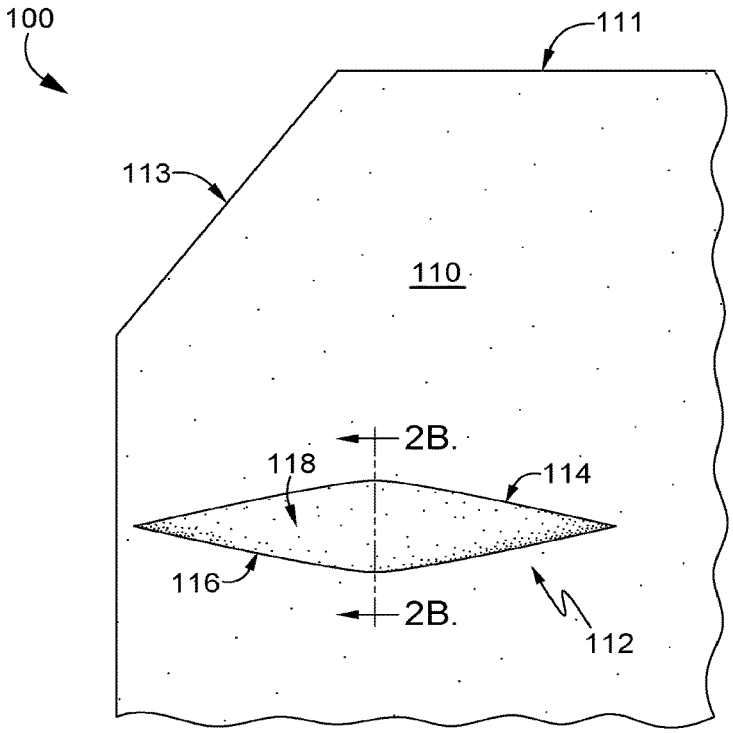
FIG. 2A illustrates a view of the first surface of the first panel of material showing the gusset insert in an expanded state in accordance with aspects herein.
Figure 2B:
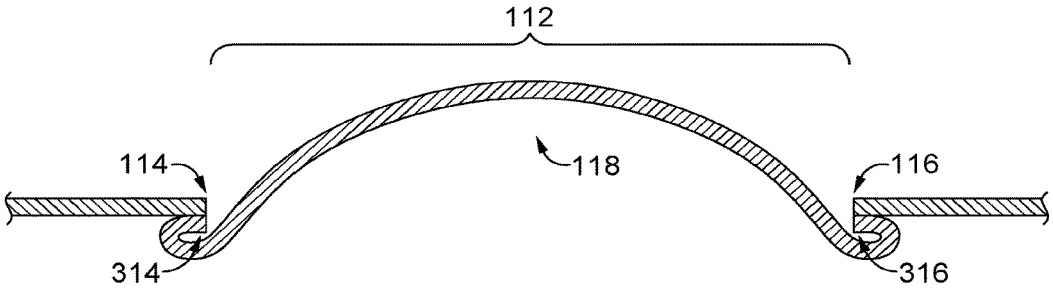
FIG. 2B illustrates a cross-sectional view taken along cut line 2B-2B in accordance with aspects herein.

Turning now to FIGS. 1A, 1B, 2A, and 2B, views of a first surface 110 of a first panel of material 100 used to form an exemplary pocket structure are provided in accordance with aspects herein, where FIGS. 1A and 1B illustrate a gusset insert in an unexpanded or folded state, and FIGS. 2A and 2B illustrate the gusset insert in an expanded or unfolded state. The first panel of material 100 may comprise any known pliable material used in the production of garments or apparel. In exemplary aspects, the first panel of material 100 may comprise a non-stretch material, a two-way stretch material, and/or a four-way stretch material. When the pocket structure is incorporated into a garment, the first surface 110 of the first panel of material 100 would comprise an outer-facing surface of the pocket structure (the surface of the pocket structure configured to face away from a body of a wearer). Further, the first panel of material 100 may comprise the outermost layer of the pocket structure with respect to a wearer's body. In exemplary aspects, the first panel of material 100 comprises at least an upper margin 111 and may also comprise additional margins such as margin 113 that is used to form an opening into the pocket structure.

Further, the first panel of material 100 comprises a linear opening or aperture 112 defined by at least two respective edges 114 and 116. The aperture 112 may be formed by, for example, laser cutting the first panel of material 100. Other ways of forming the aperture 112 are contemplated herein such as water jet cutting, ultrasonic cutting, mechanical cutting, and the like. As well, the aperture 112 may be formed by modifying the knitting or weaving process used to form the first panel of material 100 to integrally form the aperture 112. Any and all aspects, and any variation thereof, are contemplated as being within the scope herein. The aperture 112 is positioned a predetermined distance below the upper margin 111 where the predetermined distance may be dependent upon the type of garment in which the pocket structure is to be incorporated, the location of the pocket structure on the garment, the type of object that will likely be stowed within the pocket structure, and the like.

Continuing, a gusset insert 118 is positioned between and secured to the edges 114 and 116 of the aperture 112 such that the gusset insert 118 spans the aperture 112. This positioning is shown more clearly in FIGS. 1B and 2B. FIG. 1B is a cross-sectional view taken along cut line 1B-1B of FIG. 1A, and FIG. 2B is a cross-sectional view taken along cut line 2B-2B of FIG. 2A. With respect to FIG. 1B, the gusset insert 118 is shown in a folded state such that it comprises one or more folds 121. The particular folded arrangement shown in FIG. 1B is exemplary only, and it is contemplated that the gusset insert 118 may be folded in other patterns in accordance with aspects herein. The gusset insert 118 is secured to the first panel of material 100 along at least two of its edges 314 and 316 so that the body of the gusset insert 118 spans the aperture 112 in the first panel of material 100. More particularly, the edge 314 of the gusset insert 118 is secured to the edge 114 of the first panel of material 100, and the edge 316 of the gusset insert 118 is secured to the edge 116 of the first panel of material 100. When the gusset insert 118 is in the folded or unexpanded state, the edges 114 and 116 of the first layer of material 100 are positioned generally adjacent to each other as shown in FIGS. 1A and 1B. In other words, in this state, the distance between the respective edges 114 and 116 is minimal (i.e., less than 2 cm). This minimal distance helps to present a more streamlined aesthetic to the pocket structure when the pocket structure is not being used to stow an object such as a ball.

With respect to FIGS. 2A and 2B, as mentioned FIG. 2A illustrates the gusset insert 118 in an expanded or unfolded state. In the expanded or unfolded state, the edges 114 and 116 of the first layer of material 100 are spaced apart from each other. In other words, in this state, the distance between the respective edges 114 and 116 is greater than the distance between the edges 114 and 116 when the gusset insert 118 is in an unexpanded or folded state. The distance between the edges 114 and 116 when the gusset insert 118 is in an expanded or unfolded state may depend on the type of object being stowed within the pocket, the dimensions associated with the gusset insert 118, the elasticity of the materials used to form the gusset insert 118 and/or the first panel of material 100, and the like. For instance, a larger object may cause the distance between the edges 114 and 116 to be greater than when a smaller object is stowed in the pocket structure. As explained in greater depth below, the expansion of the gusset insert 118 and the spacing apart of the edges 114 and 116 helps to increase the interior volume of the pocket structure.

FIG. 2B illustrates a cross-sectional view when the gusset insert 118 is in the expanded or unfolded state due to, for example, an object being stowed within the pocket structure. Because the object is adapted to exert an outward force on the first panel of material 100, the gusset insert 118 is configured to expand outward through the aperture 112. To put it another way, when the pocket structure is incorporated into a garment, the gusset insert 118 is configured to expand away from a wearer's body surface when the garment is in an as-worn configuration.

Figure 4:
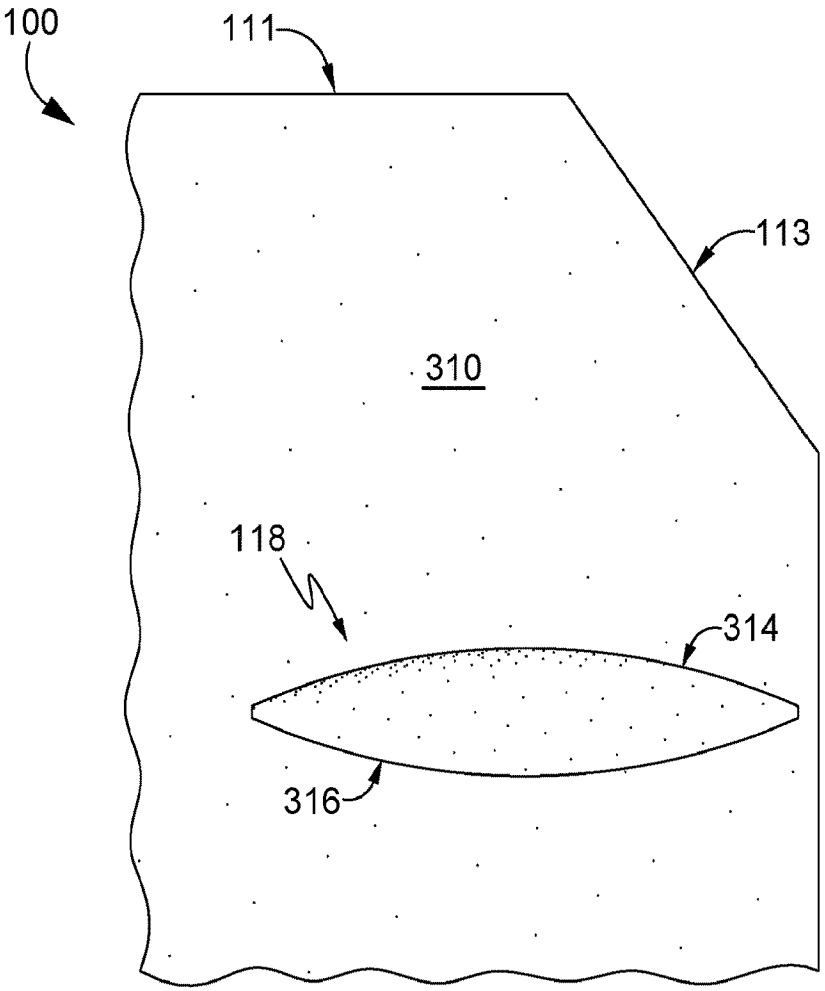
FIG. 4 illustrates a view of the second surface of the first panel of material showing the gusset insert in an expanded state in accordance with aspects herein.
Figure 3:
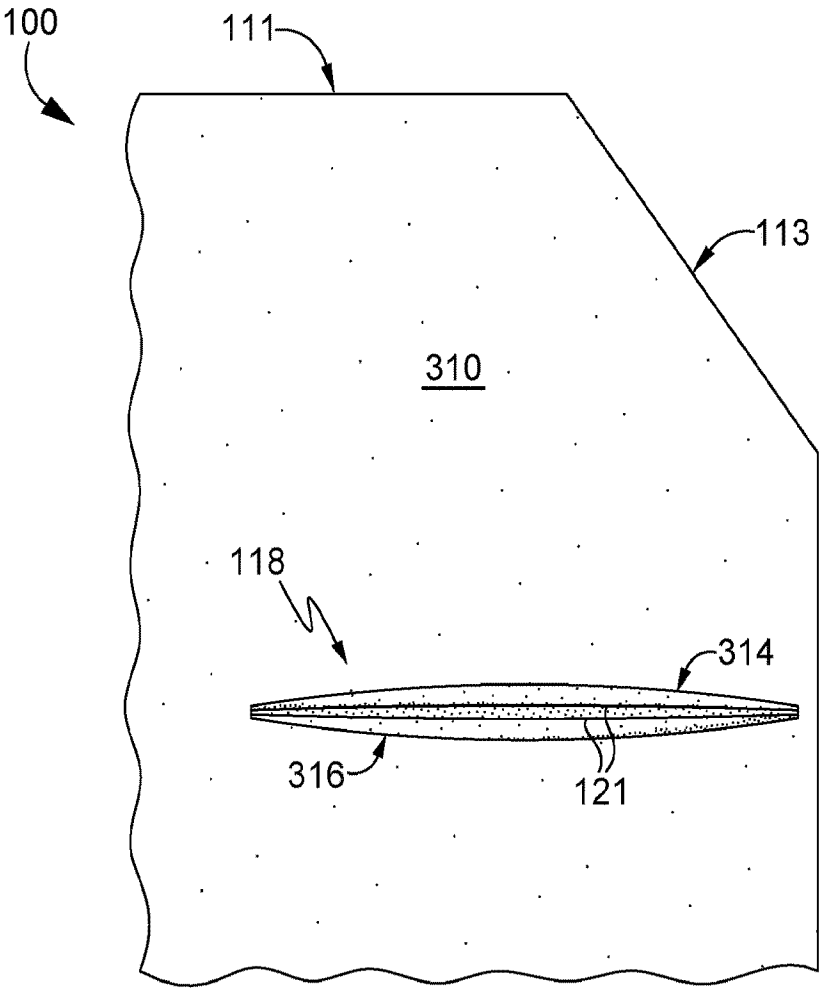
FIG. 3 illustrates a view of a second surface of the first panel of material showing the gusset insert in an unexpanded state in accordance with aspects herein.

Turning now to FIGS. 3 and 4, these figures depict views of a second surface 310 of the first panel of material 100 where the second surface 310 is opposite of the first surface 110. FIG. 3 illustrates the gusset insert 118 in an unexpanded or folded state, and FIG. 4 illustrates the gusset insert 118 in an expanded or unfolded state. When the first panel of material 100 is incorporated into a pocket structure, the second surface 310 would face toward the interior compartment space of the pocket structure. In exemplary aspects, the gusset insert 118 is formed from a pliable material (elastic or non-stretch) and, as shown in FIG. 4, has a shape when it is expanded so that its width at the midpoint of the gusset insert's longitudinal axis is greater than its width at the endpoints of the gusset insert 118. For example, exemplary shapes may comprise a diamond shape, an oval shape, an ellipsoid shape, and the like.

With further respect to FIGS. 3 and 4, the gusset insert 118 comprises at least the two perimeter edges 314 and 316. As previously described, the edge 314 may be affixed to the edge 114 of the first panel of material 100, and the edge 316 may be affixed to the edge 116 of the first panel of material 100. Any additional edges would be affixed to the first panel of material 100 so that the gusset insert 118 completely covers or spans the aperture 112. Affixing may be through, for example, adhesives, bonding, stitching, welding, and the like. In some exemplary aspects, the gusset insert 118 may be formed by modifying the knitting or weaving process used to form the first panel of material 100. In this instance, the gusset insert 118 would comprise an integral part of the first panel of material 100. In other words, the gusset insert 118 would be formed from the same yarns as those used to form the first panel of material 100. With respect to this aspect, the first panel of material 100 with its gusset insert 118 would be considered seamless. Any and all aspects, and any variation thereof, are contemplated as being within aspects herein.

As shown in FIG. 3, the gusset insert 118 is in an unexpanded or folded state as indicated by folds 121. This state may exist when an object is not being stowed within the pocket structure and minimal tensioning forces are being applied to the first panel of material 100. When the gusset insert 118 is in the unexpanded or folded state, its width at the midpoint of the insert's longitudinal axis may be generally the same (within, for example, 1 cm or less) as the width at the endpoints of the gusset insert 118.

In FIG. 4, the gusset insert 118 is shown in the expanded or unfolded state, which may be in response to an object being stowed within the pocket structure and exerting tensioning forces against the gusset insert 118. In the expanded or unfolded state, the gusset insert 118 assumes a shape where the width at the midpoint of the gusset insert 118 is greater than the width at the endpoints of the gusset insert 118 (i.e., a diamond shape, an oval shape, and ellipsoid shape, and the like).

Figure 5:
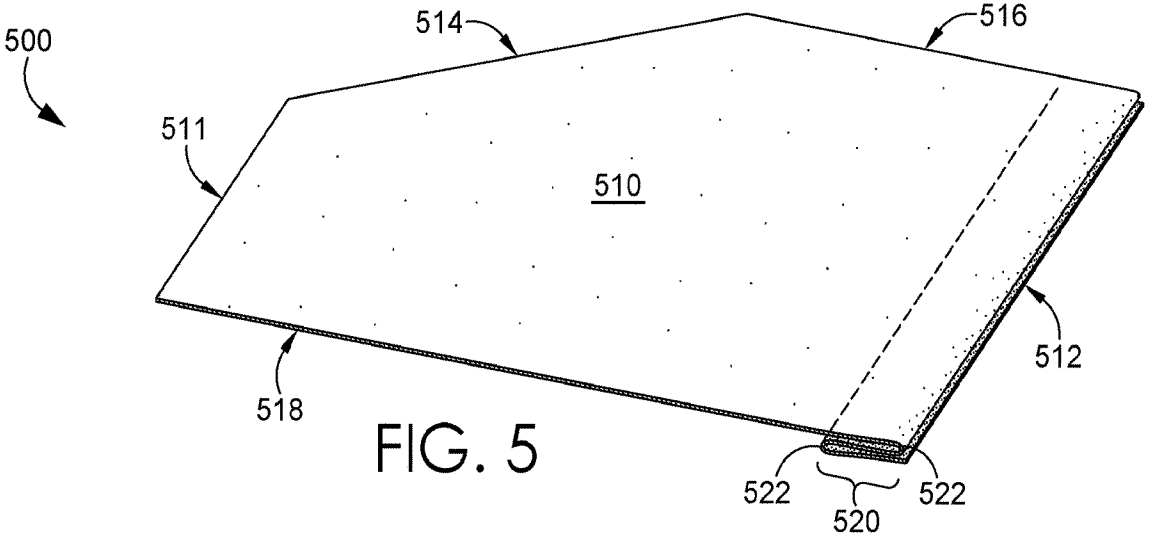
FIG. 5 illustrates a perspective view of a second panel of material used to form the exemplary pocket structure where the second panel of material includes a pleat structure shown in an unexpanded state in accordance with aspects herein.
Figure 6:
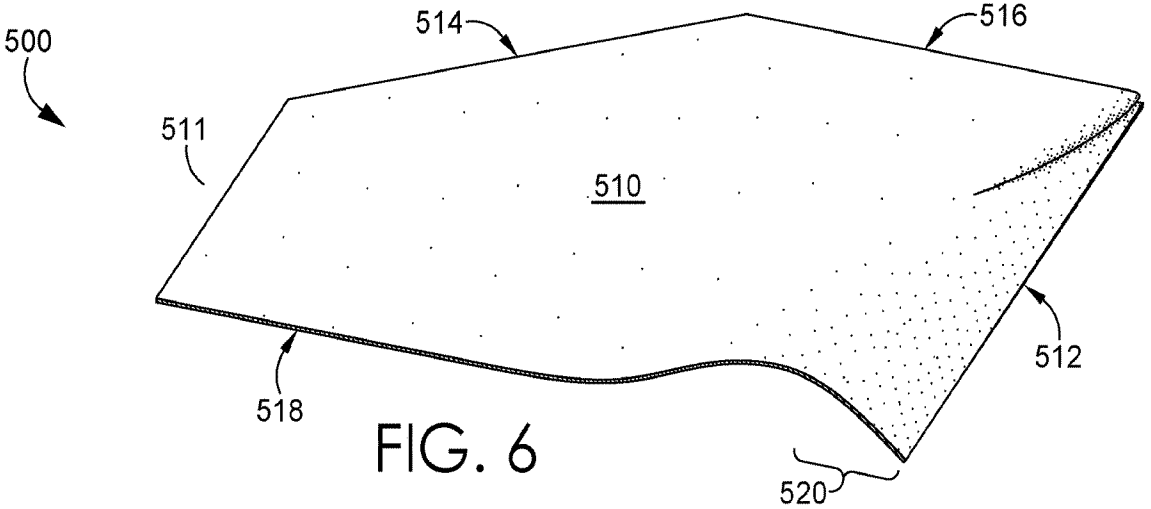
FIG. 6 illustrates a perspective view of the second panel showing the pleat structure in an expanded state in accordance with aspects herein.

Turning now to FIGS. 5 and 6, perspective views of a first surface 510 of a second panel of material 500 used to form the exemplary pocket structure are provided in accordance with aspects herein, where FIG. 5 illustrates a pleat structure in an unexpanded or folded state, and FIG. 6 illustrates the pleat structure in an expanded or unfolded state. Similar to the first panel of material 100, the second panel of material 500 may comprise any known pliable material used in the production of garments or apparel. The material may exhibit no stretch, two-way stretch, and/or four-way stretch. In exemplary aspects, the second panel of material 500 may be affixed to the first panel of material 100 to form the exemplary pocket structure described herein. However, it is also contemplated herein that the second panel of material 500 may comprise an integral extension of the first panel of material 100. For instance, a knitting or weaving process may be modified to simultaneously knit or weave both the first panel of material 100 and the second panel of material 500. In this aspect, the pocket structure would comprise a seamless construction. When the pocket structure is incorporated into a garment, the first surface 510 of the second panel of material 500 would comprise an inner-facing surface of the pocket structure (the surface facing toward a body of a wearer and away from the interior compartment of the pocket structure).

In exemplary aspects, the second panel of material 500 may comprise at least an upper margin 511 and a bottom margin 512. The second panel of material 500 may also comprise additional perimeter edges or margins such as margin 514, margin 516, and margin 518. When the second panel of material 500 is joined to the first panel of material 100 to form the pocket structure, at least the margin 514 may be aligned with the margin 113 of the first panel of material 100 to form an opening into the pocket structure. Some or all of the remaining margins, such as the margins 511, 512, 516, and 518 of the second panel of material 500 may be secured or affixed to the first panel of material 100 to form the pocket structure.

In exemplary aspects, the bottom margin 512 of the second layer of material 500 may be formed into a pleat structure 520 comprising one or more folds as indicated by, for instance, reference numeral 522. In one exemplary aspect, the longitudinal axis of the folds 522 of the pleat structure 520 may be in a generally parallel alignment with the upper margin 511 of the second panel of material 500. And, as shown with respect to FIGS. 7 and 8, the longitudinal axis of the folds 522 may also be in a generally parallel alignment with the longitudinal axis of the gusset insert 118.

As the pleat structure 520 forms the bottom margin 512 of the pocket structure, objects that are stowed within the pocket structure will generally be positioned adjacent to and/or in contact with the pleat structure 520 due to gravity. The object stowed within the pocket structure will cause the pleat structure 520 to expand or unfold as shown in FIG. 6. Similar to the gusset insert 118, the expansion of the pleat structure 520 helps to increase the interior volume of the pocket structure.

Figure 7:
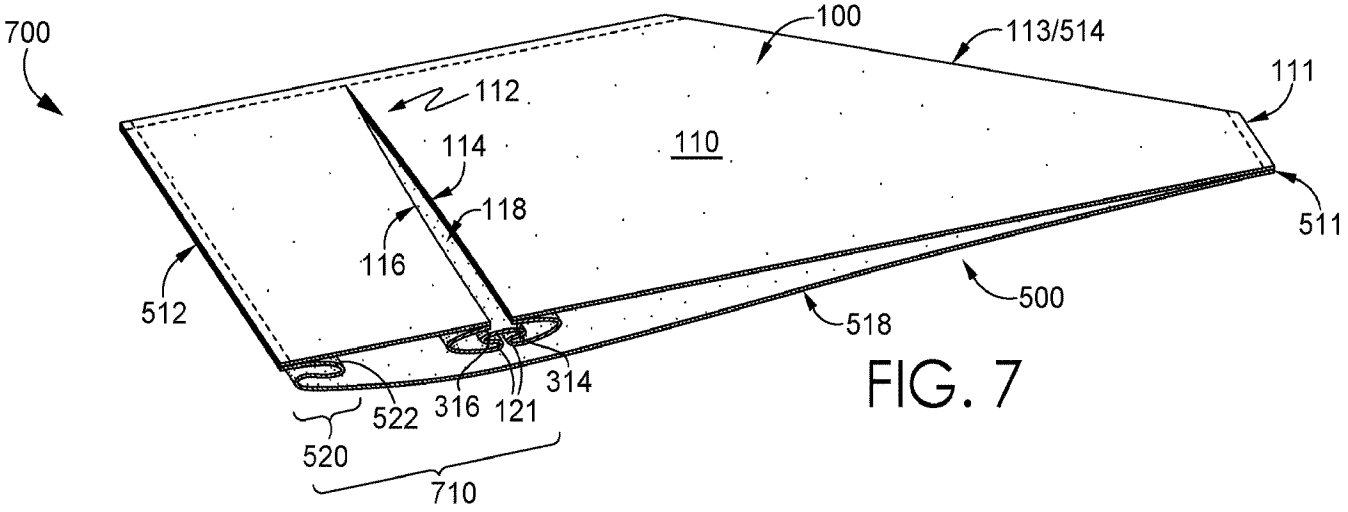
FIG. 7 illustrates a perspective view of an exemplary pocket structure where the pocket structure is in an unexpanded state in accordance with aspects herein.
Figure 8:
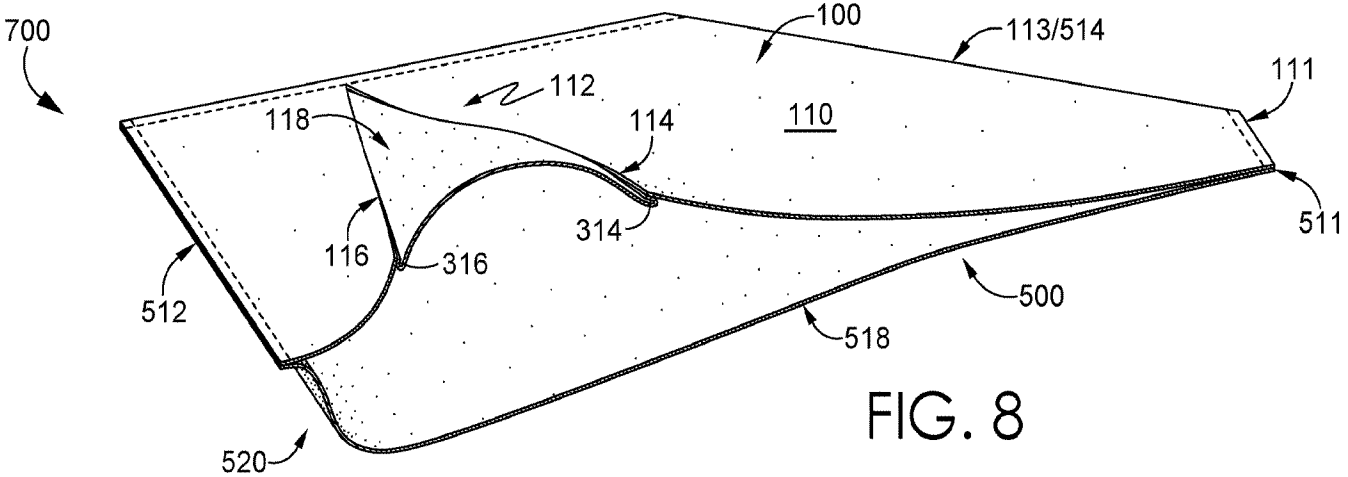
FIG. 8 illustrates a perspective view of the exemplary pocket structure of FIG. 7 where the pocket structure is in an expanded state in accordance with aspects herein.

FIGS. 7 and 8 illustrate perspective views of the first panel of material 100 secured to the second panel of material 500 to form a pocket structure 700 in accordance with aspects herein. FIG. 7 illustrates the pocket structure 700 in an unexpanded state, and FIG. 8 illustrates the pocket structure 700 in an expanded state. As shown in at least FIG. 7, the gusset insert 118 is in a generally parallel alignment with the pleat structure 520. Further, the gusset insert 118 is positioned superior to the pleat structure 520 by a predetermined distance 710. In exemplary aspects, the predetermined distance 710 may be dependent upon the characteristics of the object configured to be stowed in the pocket structure 700. For instance, a typical tennis ball comprises a spherical object having a diameter between 6.54 cm and 6.86 cm as measured from the center of the ball. The distance 710 between the gusset insert 118 and the pleat structure 520 may be selected to be generally half the diameter of the ball (i.e., its radius) or between 2.5 cm and 3.5 cm. By positioning the gusset insert 118 superior to the pleat structure 520 by the predetermined distance 710, when the bottom of the ball is resting adjacent the pleat structure 520, the center of the ball would be positioned on a plane with the gusset insert 118. Thus, when the tennis ball is stowed within the pocket structure 700, the portion of the ball corresponding to its greatest circumference is positioned adjacent to the gusset insert 118, and the gusset insert 118 can expand or unfold to accommodate the ball's diameter.

Figure 9:
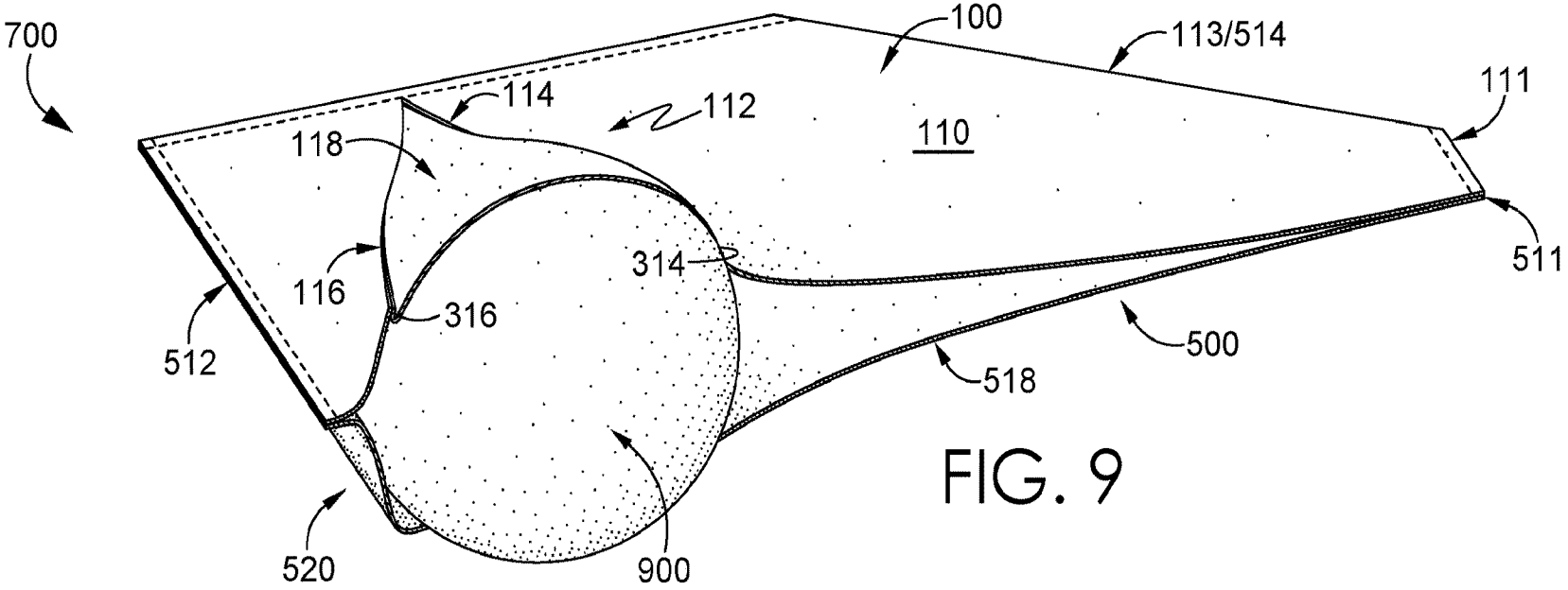
FIG. 9 illustrates a perspective view of the exemplary pocket structure of FIGS. 7 and 8 showing a ball stowed within the pocket structure in accordance with aspects herein.

This is shown more clearly in FIG. 9 which illustrates a ball 900, such as a tennis ball, stowed within the pocket structure 700. As seen in FIG. 9, the portion of the ball 900 corresponding to its greatest circumference (i.e., the ball's "equator") is positioned adjacent to the gusset insert 118, and the bottom of the ball 900 is positioned adjacent to the pleat structure 520 which forms the bottom margin 512 of the pocket structure 700. By the ball 900 causing simultaneous expansion of both the pleat structure 520 and the gusset insert 118, the interior volume of the pocket structure 700 is increased, and the pocket structure 700 is better able to accommodate the ball's volume. Moreover, the expansion of the pleat structure 520 creates a somewhat planar surface on which the bottom of the ball 900 can rest. This generally planar surface, combined with the increased interior volume of the pocket structure 700, may help to seat the ball 900 and may help to prevent its inadvertent escape. Further, by the pocket 700 being configured to accommodate the ball 900 through expansion of the gusset insert 118 and the pleat structure 520, the tension forces generated by the ball 900 on the pocket structure 700 are reduced. As a result, portions of a garment surrounding the pocket structure 700 may not be stretched unnecessarily and the garment as a whole may present a smoother more streamlined aesthetic. Moreover, because the gusset insert 118 is positioned on the outer-facing panel (e.g., the first panel of material 100) of the pocket structure 700, expansion of the gusset insert 118 occurs primarily outward or away from the wearer's body, which may further improve wearer comfort.

Figure 11:
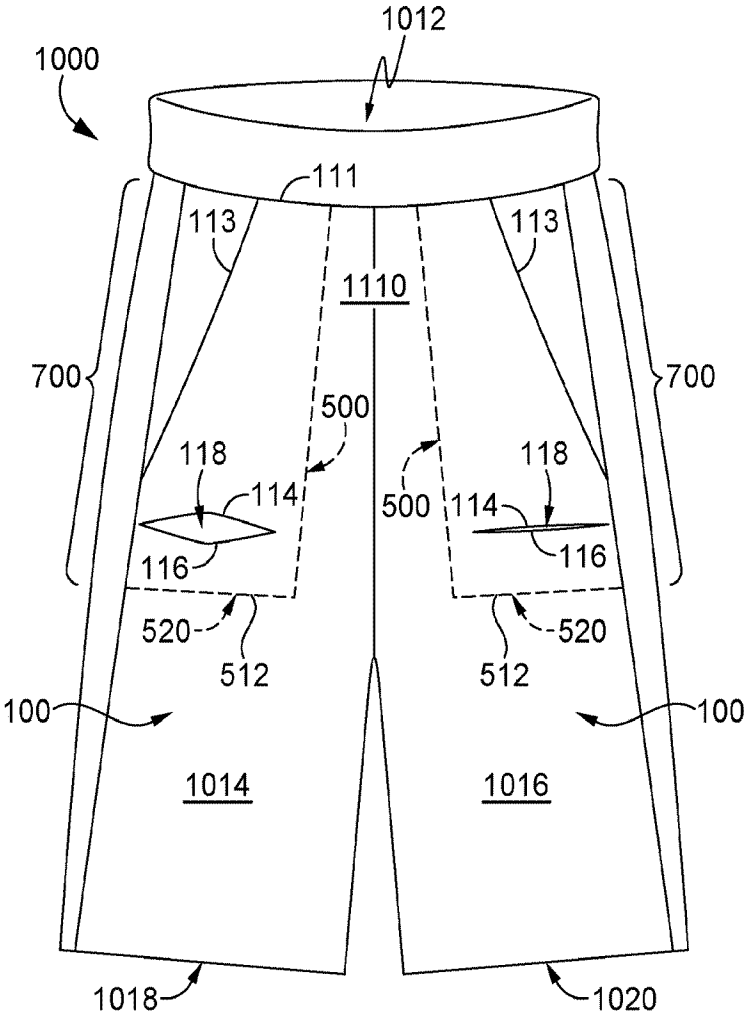
FIG. 11 illustrates a front view of the garment of FIG. 10, where the pocket structure is in an expanded state in accordance with aspects herein.
Figure 10:
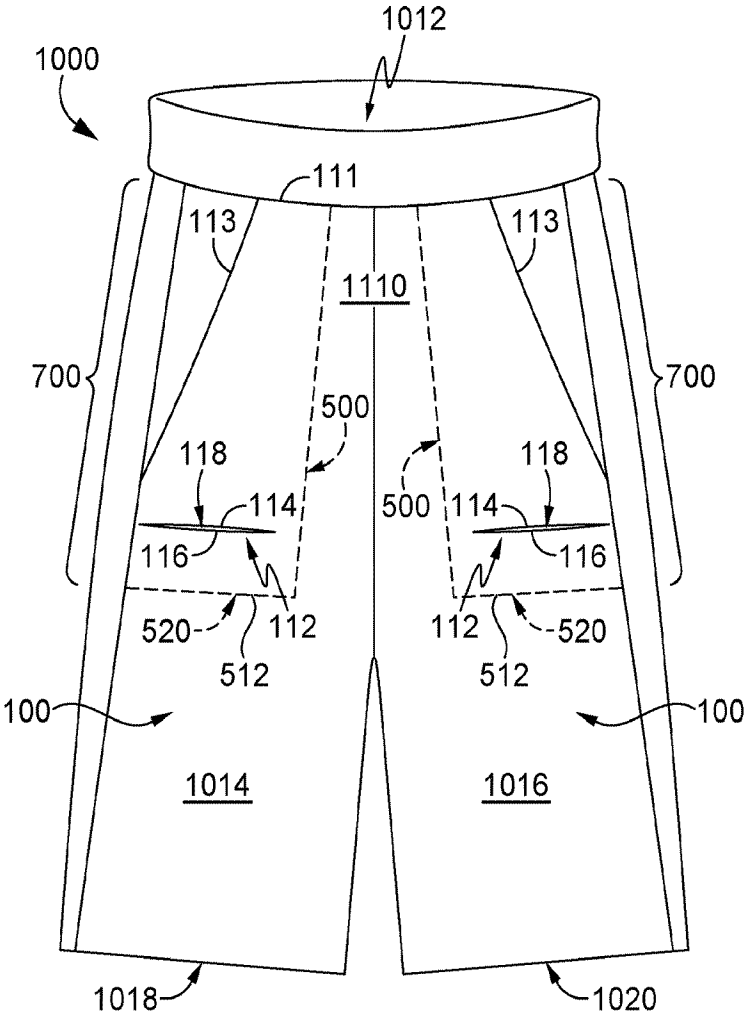
FIG. 10 illustrates a front view of a garment having the exemplary pocket structure, where the pocket structure is in an unexpanded state in accordance with aspects herein.

FIGS. 10 and 11 depict front views of a garment 1000 incorporating the exemplary pocket structure 700 described herein in accordance with aspects herein. FIG. 10 depicts the garment 1000 having the pocket structures 700 in an unexpanded state, and FIG. 11 depicts the garment having at least one of the pocket structures 700 in an expanded state. The garment 1000 is shown as a pair of shorts, although it is contemplated herein that the garment 1000 may be in the form of pants, capris, and the like.

The garment 1000 comprises at least a torso portion 1110 adapted to cover the front and back lower torso areas of a wearer when the garment 1000 is worn. The torso portion 1110 defines at least a waist opening 1012. The garment 1000 further comprises a first leg portion 1014 and a second leg portion 1016 defining a first leg opening 1018 and a second leg opening 1020 respectively. The first and second leg portions 1016 and 1018 are adapted to cover at least a portion of the legs of a wearer when the garment 1000 is worn. The pocket structures 700 are shown as being positioned generally on a front aspect of the torso portion 1110 with one pocket structure 700 positioned along a front right side of the torso portion 1110 and the first leg portion 1014 and the second pocket structure 700 positioned along a front left side of the torso portion 1110 and the second leg portion 1016.

In exemplary aspects, all or portions of the garment 1000 may be formed from the first layer of pliable material 100. For example, the first layer of pliable material 100 may be used to form the torso portion 1110 and/or the first and second leg portions 1014 and 1016. Thus, the upper margin 111 of the first layer of pliable material 100 may help to define the waist opening 1012 of the garment 1000. The margin 113 of the first layer of pliable material 100 may help to form an opening to the pocket structure 700. Further, the aperture 112 formed in the first layer of pliable material 100 is visible on the outer-facing surface of the garment. As depicted in FIGS. 10 and 11, the aperture 112 is positioned a first distance from the waist opening 1012 of the garment 1000. With respect to FIG. 10, the edges 114 and 116 of the aperture 112 are positioned generally adjacent to each other, and the gusset insert 118 is positioned between the edges 114 and 116. The second panel of material 500 is indicated by the dashed lines. It forms the inner layer of each of the pocket structures 700. As described earlier, the pleat structure 520 of the second layer of material 500 is positioned inferior to or below the aperture 112 in the first layer of material 100 so that it is positioned a second distance from the waist opening 1012 of the garment 1000. In exemplary aspects, the second distance is greater than the first distance. Further, in exemplary aspects, the pleat structure 520 is in a generally parallel alignment with the aperture 112 and the gusset insert 118. And, as described above, the pleat structure 520 generally forms the bottom margin 512 of the pocket structure 700. positioned generally adjacent to each other, and the gusset insert 118 is positioned between the edges 114 and 116. The second panel of material 500 is indicated by the dashed lines. It forms the inner layer of each of the pocket structures 700. As described earlier, the pleat structure 520 of the second layer of material 500 is positioned inferior to or below the aperture 112 in the first layer of material 100 so that it is positioned a second distance from the waist opening 1012 of the garment 1000. In exemplary aspects, the second distance is greater than the first distance. Further, in exemplary aspects, the pleat structure 520 is in a generally parallel alignment with the aperture 112 and the gusset insert 118. And, as described above, the pleat structure 520 generally forms the bottom margin 512 of the pocket structure 700.

Because FIG. 10 depicts the pocket structures 700 in an unexpanded state due to, for example, the absence of an object being stowed in the pocket structures, the pocket structures 700 present a generally flat or planar surface. FIG. 11 depicts one of the pocket structures 700 with the gusset insert 118 expanded or unfolded and the pleat structure 520 expanded or unfolded. This state may occur in response to, for example, a ball or other type of spherical object being stowed within the pocket structure 700. As shown, the gusset insert 118 expands away from the interior of the garment 1000 (i.e., away from a body of a wearer when the garment 1000 is worn).

Figure 13:
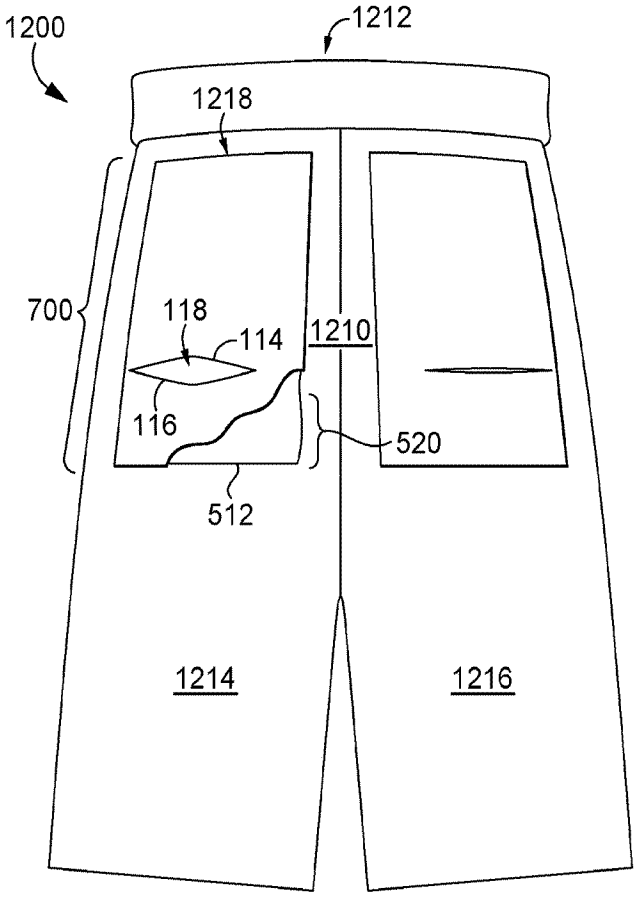
FIG. 13 illustrates a back view of the garment of FIG. 12, where the pocket structure is in an expanded state in accordance with aspects herein.
Figure 12:
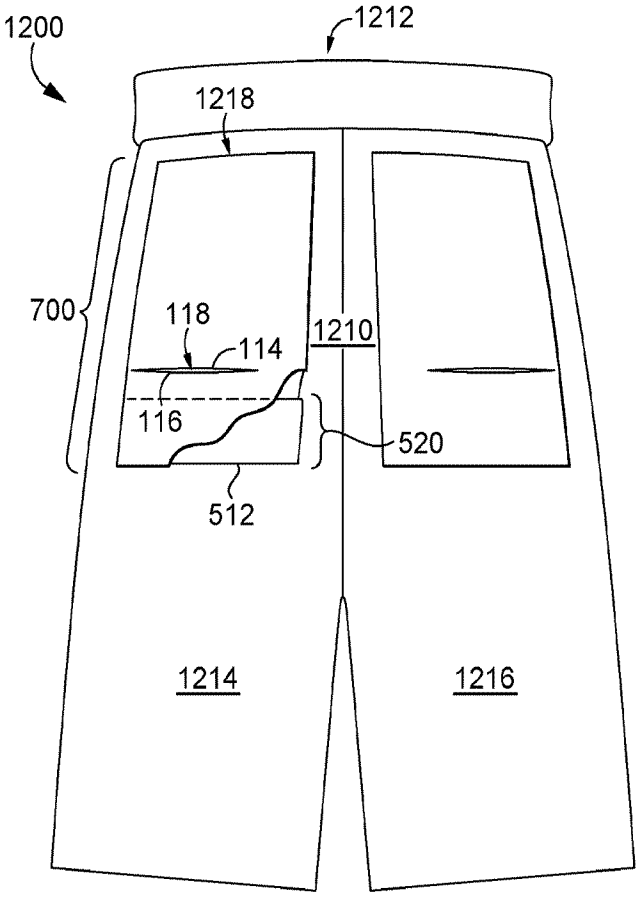
FIG. 12 illustrates a back view of a garment having the exemplary pocket structure, where the pocket structure is in an unexpanded state in accordance with aspects herein.

FIGS. 12 and 13 depict back views of another exemplary garment 1200 in accordance with aspects herein, where FIG. 12 illustrates the pocket structures 700 in an unexpanded or folded state, and FIG. 13 illustrates one of the pocket structures 700 in an expanded or unfolded state. The garment 1200 is also shown in the form of a short, although it is contemplated herein that the garment 1200 may be in the form of a pant, a three-quarter pant, a capri, and the like. The garment 1200 comprises a torso portion 1210 adapted to cover a front and back torso of a wearer, where the torso portion 1210 defines, at least in part, a waist opening 1212. The garment 1200 further comprises first and second leg portions 1214 and 1216. The garment 1200 illustrates another exemplary location for the pocket structure 700. Besides being positioned on the front of a garment, the pocket structure 700 can additionally be located on the back of a garment. With respect to the garment 1200, the pocket structures 700 are located on a back right side of the torso portion 1210 and a back left side of the torso portion 1210, and each present an opening 1218 for accessing the pocket structure 700.

At least one of the pocket structures 700 is shown with the first panel of material 100 cut away to reveal the pleat structure 520 forming the bottom margin 512 of the pocket structure 700. As shown, the pleat structure 520 is in a generally parallel alignment with the gusset insert 118. Further, both the pleat structure 520 and the gusset insert 118 are in a generally parallel alignment with the waist opening 1212 of the garment 1200. As shown in FIG. 12, the gusset insert 118 is in a folded or unexpanded state such that the edges 114 and 116 of the aperture 112 are closely approximated to each other. As further shown in FIG. 12, the pleat structure 520 is in a folded or unexpanded state. FIG. 13 illustrates the gusset insert 118 in an expanded state. When the gusset insert 118 is expanded, the edges 114 and 116 of the aperture 112 are spaced apart from one another. FIG. 13 further illustrates the pleat structure 520 in an unfolded state.

Figure 15:
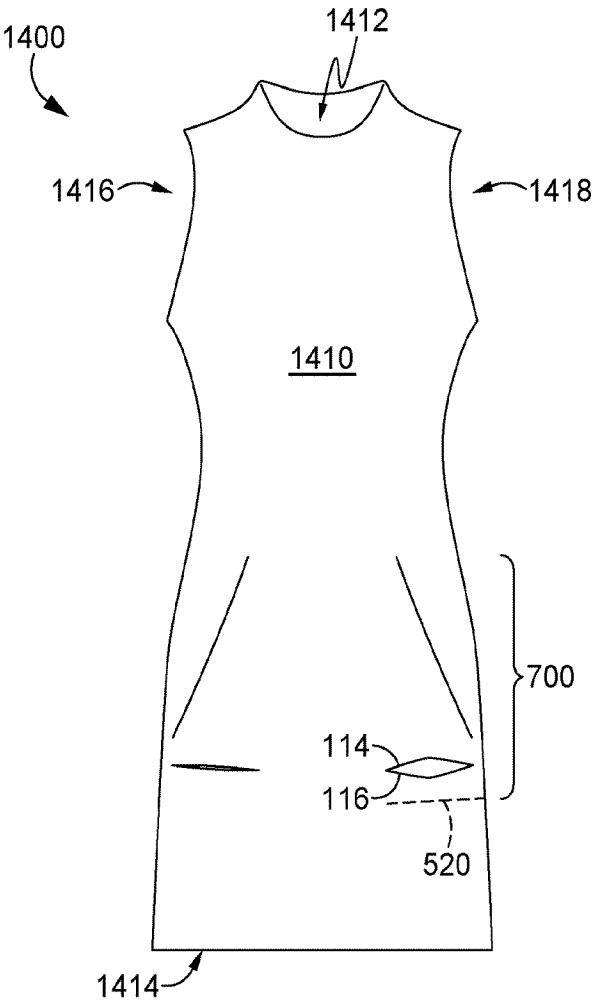
FIG. 15 illustrates a front view of the garment of FIG. 14, where the pocket structure is in an expanded state in accordance with aspects herein.
Figure 14:
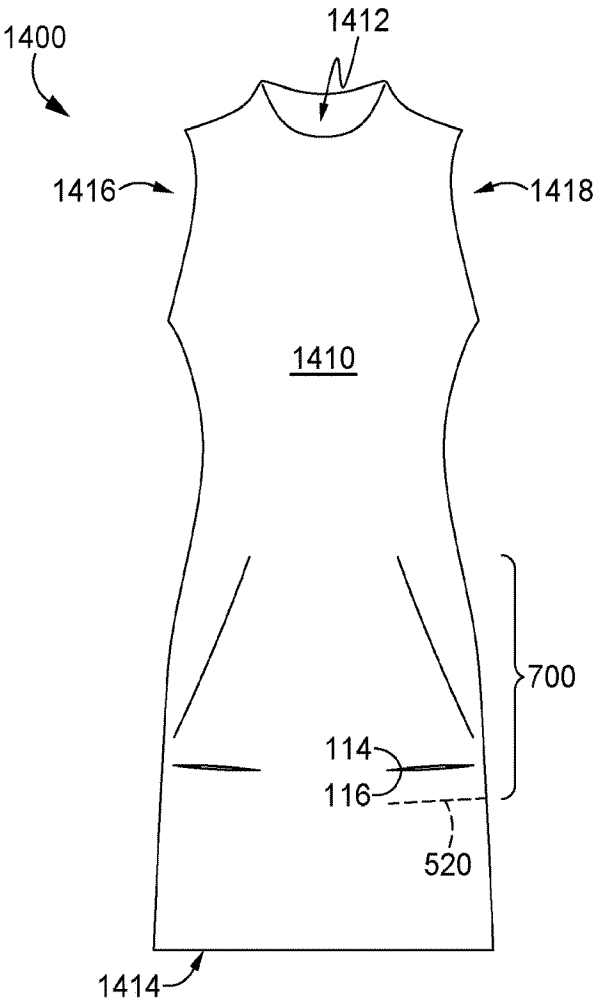
FIG. 14 illustrates a front view of a garment having the exemplary pocket structure, where the pocket structure is in an unexpanded state in accordance with aspects herein.

FIGS. 14 and 15 illustrate front views of another exemplary garment 1400 incorporating the pocket structure 700 in accordance with aspects herein. The garment 1400 is in the form of a dress such as, for example, a tennis dress. Although shown as a dress, it is contemplated herein that the garment 1400 may be in the form of a shirt, a skort, a skirt, and the like. The garment 1400 may comprise a torso portion 1410 that defines, at least in part, a neck opening 1412, a waist opening 1414 opposite the neck opening 1412, and first and second sleeve openings 1416 and 1418. The garment 1400 may optionally comprise sleeve portions extending from the sleeve openings 1416 and 1418.

The garment 1400 is shown comprising two pocket structures 700 with the pocket structures 700 located on opposing sides of a front aspect of the torso portion 1410. It is contemplated herein that the pocket structures 700 may be positioned at other locations on the garment 1400 such as on a back torso portion, or a side aspect of a torso portion. Further, it is contemplated that the garment 1400 may comprise just one pocket structure 700 or multiple pocket structures 700. Any and all aspects, and any variation thereof, are contemplated as being within the scope herein.

The pocket structures 700 are shown in an unexpanded or folded state in FIG. 14, and one of the pocket structures 700 is shown in an expanded or unfolded state in FIG. 15. This may be incident to a wearer stowing an object, such as a ball, within the pocket structure 700. In exemplary aspects, the aperture 112 may be positioned a first distance from the neck opening 1412, and the pleat structure 520 may be positioned a second distance from the neck opening 1412, where the second distance is greater than the first distance. Further, similar to the garments described above, the aperture 112 and its gusset insert 118 are in a generally parallel alignment with the pleat structure 520.

The garments shown in FIGS. 10-15 are exemplary only, and it is contemplated that the exemplary pocket structure 700 described herein may be incorporated into any article of apparel including, for example, hats, socks, shin guards, shoes, and the like. Further, the locations and positioning of the pocket structures 700 shown in FIGS. 10-15 are exemplary only, and it is contemplated that the pocket structure 700 described herein may be positioned at any location on an article of apparel that is suited for easy access by a wearer. Any and all aspects, and any variation thereof, are contemplated as being within the scope herein.

Aspects of the present invention have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A pocket structure comprising:

a first panel of material comprising a first surface and a second surface opposite the first surface, the first panel of material comprising a gusset insert having a longitudinal axis and expandable from a first state to a second state; and a second panel of material affixed to the first panel at one or more perimeter edges of the second panel of material, the second panel of material comprising a third surface and a fourth surface opposite the third surface, the second panel of material affixed to the first panel of material so that the fourth surface of the second panel of material is positioned adjacent to the second surface of the first panel of material, at least a first perimeter edge forming at least part of a bottom margin of the second panel of material and having a pleat structure expandable from a first state to a second state, the pleat structure being in parallel alignment with the bottom margin of the second panel of material and the longitudinal axis of the gusset insert, wherein the first panel of material comprises an upper edge and an opening edge adjacent to and converging with the upper edge of the first panel of material and wherein the second panel of material comprises an upper edge and an opening edge adjacent to and converging with the upper edge of the second panel of material, wherein an opening into the pocket structure is formed by the opening edge of the first panel of material and the opening edge of the second panel of material, wherein the gusset insert is positioned a first distance from the opening of the pocket structure, and wherein the pleat structure is positioned a second distance from the opening of the pocket structure, and wherein the second distance is greater than the first distance.

2. The pocket structure of claim 1, wherein the first panel of material comprises an aperture defined by two or more respective edges, and wherein the gusset insert is positioned between and affixed to the two or more respective edges of the aperture.

3. The pocket structure of claim 1, wherein the opening of the pocket structure is sized to receive a ball, and wherein when the ball is received within the pocket structure, a bottom portion of the ball is configured to be positioned adjacent to the pleat structure and causes the pleat structure to expand from the first state to the second state, and wherein when the ball is received within the pocket structure, a portion of the ball corresponding to the ball's greatest circumference is configured to be positioned adjacent to the gusset insert and causes the gusset insert to expand from the first state to the second state.

4. The pocket structure of claim 1, wherein the gusset insert is positioned at a distance superior to the pleat structure, the distance being between 2.5 centimeters and 3.5 centimeters.

5. A garment comprising:

a torso portion defining at least a waist opening;

first and second leg portions extending from the torso portion, the first and second leg portions defining first and second leg openings respectively; and a pocket structure comprising:

a first panel of material comprising a first surface and a second surface opposite the first surface, the first panel of material comprising a gusset insert having a longitudinal axis and being expandable from a first state to a second state, and a second panel of material affixed to the first panel of material at one or more perimeter edges of the second panel of material, the second panel of material comprising a third surface and a fourth surface opposite the third surface, the second panel of material affixed to the first panel of material so that the fourth surface of the second panel of material is positioned adjacent to the second surface of the first panel of material, at least a first perimeter edge forming at least part of a bottom margin of the second panel of material and having a pleat structure expandable from a first state to a second state, the pleat structure being in parallel alignment with the bottom margin of the second panel of material and the longitudinal axis of the gusset insert, wherein the first panel of material comprises an upper edge and an opening edge adjacent to and converging with the upper edge of the first panel of material and wherein the second panel of material comprises an upper edge and an opening edge adjacent to and converging with the upper edge of the second panel of material, wherein an opening into the pocket structure is formed by the opening edge of the first panel of material and the opening edge of the second panel of material, wherein the gusset insert is positioned a first distance from the opening of the pocket structure, and wherein the pleat structure is positioned a second distance from the opening of the pocket structure, and wherein the second distance is greater than the first distance.

6. The garment of claim 5, wherein the first panel of material forms at least the torso portion and the first and second leg portions.

7. The garment of claim 6, wherein the first surface of the first panel of material forms an outer-facing surface of the garment, and wherein the third surface of the second panel of material forms at least in part an inner-facing surface of the garment.

8. The garment of claim 5, wherein the opening is sized to receive a ball such that when the ball is received within the pocket structure, a bottom portion of the ball is configured to be positioned adjacent to the pleat structure and causes the pleat structure to expand from the first state to the second state, and wherein when the ball is received within the pocket structure, a portion of the ball corresponding to the ball's greatest circumference is configured to be positioned adjacent to the gusset insert and causes the gusset insert to expand from the first state to the second state.

9. The garment of claim 5, wherein the gusset insert is positioned at a distance superior to the pleat structure, the distance being between 2.5 centimeters and 3.5 centimeters.

10. A garment comprising:

a torso portion defining at least a waist opening;

a pocket structure comprising:

a first panel of material comprising a first surface and a second surface opposite the first surface, the first panel of material comprising a gusset insert having a longitudinal axis and being expandable from a first state to a second state, and a second panel of material affixed to the first panel at one or more perimeter edges of the second panel of material, the second panel of material comprising a third surface and a fourth surface opposite the third surface, the second panel of material affixed to the first panel of material so that the fourth surface of the second panel of material is positioned adjacent to the second surface of the first panel of material, at least a first perimeter edge forming at least part of a bottom margin of the second panel of material and having a pleat structure expandable from a first state to a second state, the pleat structure being in parallel alignment with the bottom margin of the second panel of material and the longitudinal axis of the gusset insert, wherein the first panel of material comprises an upper edge and an opening edge adjacent to and converging with the upper edge of the first panel of material and wherein the second panel of material comprises an upper edge and an opening edge adjacent to and converging with the upper edge of the second panel of material, wherein an opening into the pocket structure is formed by the opening edge of the first panel of material and the opening edge of the second panel of material, wherein the gusset insert is positioned a first distance from the opening of the pocket structure, and wherein the pleat structure is positioned a second distance from the opening of the pocket structure, and wherein the second distance is greater than the first distance.

11. The garment of claim 10, wherein the first panel of material comprises an aperture defined by at least two respective edges, and wherein the gusset insert is positioned between and affixed to the two respective edges of the aperture.

12. The garment of claim 10, wherein the gusset insert is formed from a pliable material such that when the gusset insert is in the first state, the pliable material forms one or more folds, and when the gusset insert is in the second state, the one or more folds are expanded.

13. The garment of claim 12, wherein the opening is sized to receive a ball such that when the ball is received within the pocket structure, a bottom portion of the ball is configured to be positioned adjacent to the pleat structure and causes the pleat structure to expand from the first state to the second state, and wherein when the ball is received within the pocket structure, a portion of the ball corresponding to the ball's greatest circumference is configured to be positioned adjacent to the gusset insert and causes the gusset insert to expand from the first state to the second state.

14. The garment of claim 10, wherein the gusset insert is positioned at a distance superior to the pleat structure, the distance being between 2.5 centimeters and 3.5 centimeters.

* * * * *